US010073395B2

(12) United States Patent
Okutsu et al.

(10) Patent No.: US 10,073,395 B2
(45) Date of Patent: Sep. 11, 2018

(54) IMAGE FORMING APPARATUS AND PRINT SHEET

(71) Applicant: FUJI XEROX CO., LTD., Tokyo (JP)

(72) Inventors: Masaru Okutsu, Kanagawa (JP); Masayuki Nishimura, Kanagawa (JP); Mizuki Sugino, Kanagawa (JP); Daisuke Tanaka, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/442,882

(22) Filed: Feb. 27, 2017

(65) Prior Publication Data

US 2018/0067433 A1 Mar. 8, 2018

(30) Foreign Application Priority Data

Sep. 7, 2016 (JP) ..... 2016-174896

(51) Int. Cl.
*G03G 15/00* (2006.01)
*B41M 5/50* (2006.01)

(52) U.S. Cl.
CPC ..... *G03G 15/50* (2013.01); *B41M 5/50* (2013.01)

(58) Field of Classification Search
USPC ..... 399/16, 38, 45, 75, 81, 391
See application file for complete search history.

(56) References Cited

U.S. PATENT DOCUMENTS

2008/0031670 A1* 2/2008 Kim ..... B65H 5/004 399/405
2013/0330093 A1* 12/2013 Kakehi ..... G03G 15/2028 399/16

FOREIGN PATENT DOCUMENTS

JP 5436035 B2 3/2014

* cited by examiner

*Primary Examiner* — Hoan Tran
(74) *Attorney, Agent, or Firm* — Sughrue Mion, PLLC

(57) ABSTRACT

An image forming apparatus includes an acquiring unit that acquires rendering information including one or both of a text and an illustration; a first image forming unit that forms an image on a sheet material based on the rendering information that has been acquired; and a second image forming unit that forms an electrostatic attraction toner image on the sheet material, the electrostatic attraction toner image being for imparting an electrostatic attraction function to the sheet material, the electrostatic attraction function allowing the sheet material to be attracted to an object surface by using static electricity.

10 Claims, 6 Drawing Sheets

FIG. 6

| NO. | SHEET | INSERTING SHEET | TONER COLOR | COVERAGE | IMMEDIATELY AFTER PRINTING (V) | EVALUATION OF ADHESION TO OBJECT TWO DAYS LATER |
|---|---|---|---|---|---|---|
| 1. | OHP | J SHEET | — | 0 | −814 | POOR |
| 2. | OHP | J SHEET | WHITE | 95% | −841 | GOOD |
| 3. | OHP | J SHEET | WHITE | 33% | −699 | POOR |
| 4. | OHP | J SHEET | WHITE | 33% | −667 | POOR |
| 5. | OHP | J SHEET | WHITE | 50% | −665 | OK (ADHERED TO OBJECT EVEN THOUGH ADHESION TIME IS NOT AS LONG AS FOR EXAMPLES WHOSE RESULT IS "GOOD" ) |
| 6. | OHP | J SHEET | WHITE | 95%+1-on-2-off VERTICAL | −660 | GOOD |
| 7. | OHP EDGELESS PRINTING | J SHEET | WHITE | 100% | −646 | GOOD |

IMAGE FORMING APPARATUS AND PRINT SHEET

CROSS-REFERENCE TO RELATED APPLICATIONS

This application is based on and claims priority under 35 USC 119 from Japanese Patent Application No. 2016-174896 filed Sep. 7, 2016.

BACKGROUND

Technical Field

The present invention relates to an image forming apparatus and a print sheet.

SUMMARY

According to an aspect of the invention, there is provided an image forming apparatus including an acquiring unit that acquires rendering information including one or both of a text and an illustration; a first image forming unit that forms an image on a sheet material based on the rendering information that has been acquired; and a second image forming unit that forms an electrostatic attraction toner image on the sheet material, the electrostatic attraction toner image being for imparting an electrostatic attraction function to the sheet material, the electrostatic attraction function allowing the sheet material to be attracted to an object surface by using static electricity.

BRIEF DESCRIPTION OF THE DRAWINGS

An exemplary embodiment of the present invention will be described in detail based on the following figures, wherein:

FIG. 6 shows experiment results in which an electrostatic attraction function is evaluated.

DETAILED DESCRIPTION

Exemplary embodiments of the invention are described in detail below with reference to the attached drawings.

Description of Image Forming Apparatus

Figure 1:
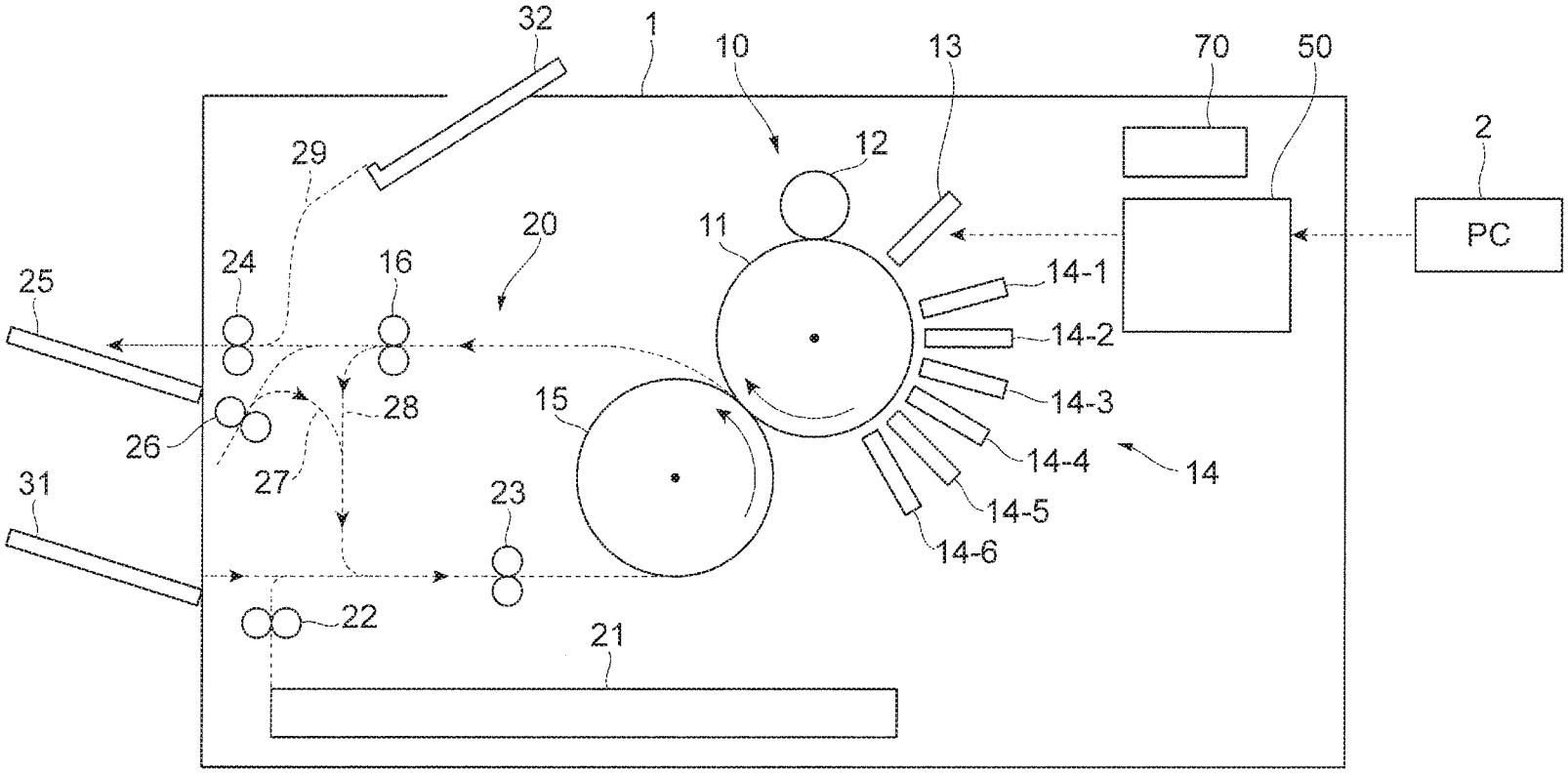
FIG. 1 illustrates an image forming apparatus to which an exemplary embodiment is applied.

FIG. 1 illustrates an image forming apparatus 1 to which an exemplary embodiment is applied. The image forming apparatus 1 forms an image on a sheet with toner by using an electrophotographic system. More specifically, the image forming apparatus 1 includes an image forming device 10 and a transporting device 20. As an electrostatic system, the image forming device 10 forms an electrostatic latent image and forms an image by using toner. The transporting device

20 transports a sheet to the image forming device 10 and discharges the sheet on which an image has been formed by the image forming device 10 to the outside of the apparatus 1. The image forming apparatus 1 also includes an image processing device 50 that performs, for example, several image processing operations on image data (rendering information) of an electronic document output from a client PC 2. The image forming apparatus 1 further includes a control panel 70, serving as a user interface, that displays operation information of the image forming apparatus 1 to a user and that accepts an operation from the user. The image processing device 50 receives a specification of an attraction mode, which is a distinguishing feature of the exemplary embodiment, from the user through the user interface, and performs control so as to form an electrostatic attraction toner image on a sheet by using the image forming device 10.

The image forming device 10 includes, for example, a photoconductor unit 11, a charging unit 12, an exposure unit 13, and a developing unit 14. The photoconductor unit 11 includes a photoconductor drum. The charging unit 12 charges the photoconductor unit 11. The exposure unit 13 exposes the photoconductor unit 11 charged by the charging unit 12. The developing unit 14 performs development with respect to the photoconductor unit 11 that has been exposed by the exposure unit 13 and on which an electrostatic latent image has been formed. The image forming device 10 still further includes a transferring unit 15 and a fixing unit 16. The transferring unit 15 transfers onto a sheet a toner image formed by the development with respect to the photoconductor unit 11 by the developing unit 14. The fixing unit 16 heats and presses the toner image transferred to the sheet by the transferring unit 15, and fixes the toner image to the sheet.

The developing unit 14 includes a Y developing unit 14-1 that performs development to form a yellow (Y) toner image, an M developing unit 14-2 that performs development to form a magenta (M) toner image, a C developing unit 14-3 that performs development to form a cyan (C) toner image, and a K developing unit 14-4 that performs development to form a black (K) toner image. The developing unit 14 also includes a clear toner developing unit 14-5 for performing development to form a transparent toner (clear toner) image, and a white toner developing unit 14-6 for performing development to form a white toner image.

The transporting device 20 includes a sheet feeding tray 21 that supplies sheets, and transporting rollers 22 that send out the sheets from the sheet feeding tray 21 and transport the sheets. The transporting device 20 also includes registration rollers 23 that transport the sheets to the transferring unit 15 with a transport timing of the sheets transported through the transporting rollers 22 being in accordance with a timing in which an image is formed. The transporting device 20 further includes discharge rollers 24 that discharge sheets to which toner images have been fixed by the fixing unit 16 to the outside of the apparatus 1, and a paper exit tray 25 that holds the sheets discharged by the discharge rollers 24.

The transporting device 20 still further includes a manual feeding tray 31. For example, transparent film sheets (such as OHP sheets) and special size sheets (such as large sheets, postcards, and letters that are not transportable from the sheet feeding tray 21) are placed on the manual feeding tray 31. Such sheets are transportable towards the image forming device 10 from the manual feeding tray 31.

The transporting device 20 still further includes reverse rollers 26 that reverse the front and back of a sheet transported through the fixing unit 16, and has a reverse path 27 for transporting the sheet whose front and back have been reversed towards the image forming device 10. The transporting device 20 also has a circulation path 28 to allow a sheet to be transported towards the image forming device 10 without reversing the front and back of the sheet transported through the fixing unit 16.

The transporting device 20 still further includes an inserting sheet tray 32 that holds interposing sheets, that is, inserting sheets for realizing insertion of an ordinary sheet, on which an image is not formed, between sheets. In accordance with a timing in which an inserting sheet is inserted between sheets on which images have been formed, a sheet placed on the inserting sheet tray 32 is transported towards the discharge rollers 24 from the sheet inserting tray 32 through a sheet inserting path 29.

Figure 2:
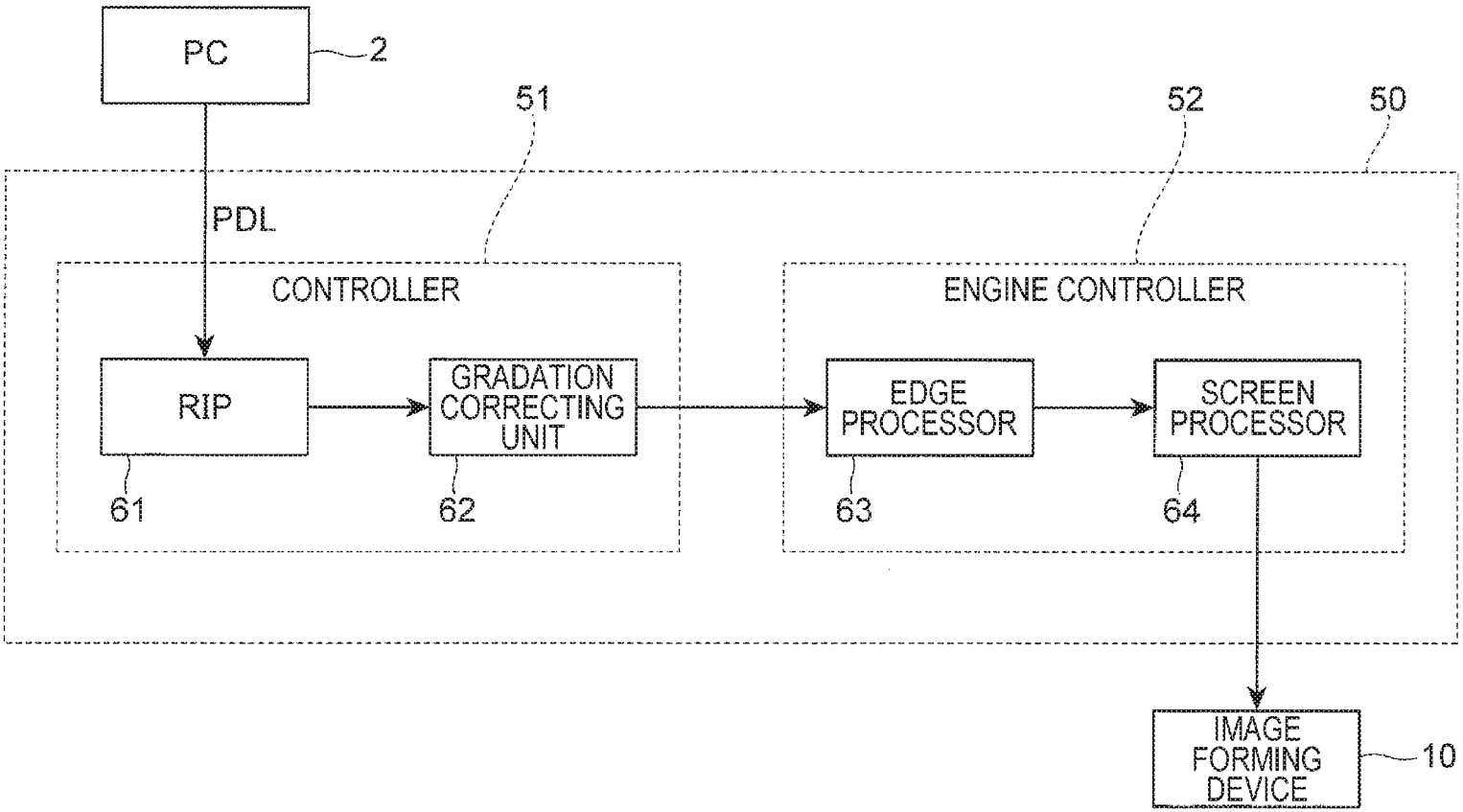
FIG. 2 is a block diagram of a structure of an image processing device to which the exemplary embodiment is applied.

FIG. 2 is a block diagram of a structure of the image processing device 50 to which the exemplary embodiment is applied. The image processing device 50 broadly includes a controller 51 and an engine controller 52. The controller 51 includes a raster image processor (RIP) 61 that performs command interpretation on page description language (PDL) sent from the client PC 2 through, for example, a network, and converts the PDL into a printable bit map format. The controller 51 also includes a gradation correcting unit 62 that performs gradation correction on data rasterized by the RIP 61. The engine controller 52 includes an edge processor 63 and a screen processor 64. The edge processor 63, for example, detects an edge for each pixel, determines the characteristics of the detected edge, and uses a predetermined look-up table (LUT) for the edge. On the basis of the characteristics of the edge determined by the edge processor 63, the screen processor 64 uses a predetermined screen for the edge. Here, screen processing refers to binary conversion processing, such as a dither method, which is an area gradation method; and uses a threshold matrix previously stored in, for example, a memory (not shown). Pulse width modulation is performed on image data processed by the screen processor 64, and the resulting image data is output to the image forming device 10.

The image processing device 50 functions as a controller when an electrostatic attraction characteristic is imparted to a sheet in the exemplary embodiment. More specifically, the image processing device 50 functions as an acquiring unit that acquires rendering information including one or both of a text and an illustration from the client PC 2. An illustration is defined as something other than a text, such as diagrams, figures, combinations thereof, and photographic images. In addition, along with the image forming device 10, the image processing device 50 functions as one first image forming unit that forms an image on a sheet material on the basis of acquired rendering information. Further, along with the image forming device 10, the image processing device 50 functions as one second image forming unit that forms an electrostatic attraction toner image on a sheet material. The electrostatic attraction toner image is formed for imparting an electrostatic attraction function to the sheet material, the electrostatic attraction function allowing the sheet material to be attracted to an object surface by using electricity. In order to reuse a printed material that has lost its attraction property once, along with the image forming device 10, the image processing device 50 functions as an enhancing unit that enhances the electrostatic attraction function by charging the electrostatic attraction toner image on the sheet material.

Figure 3:
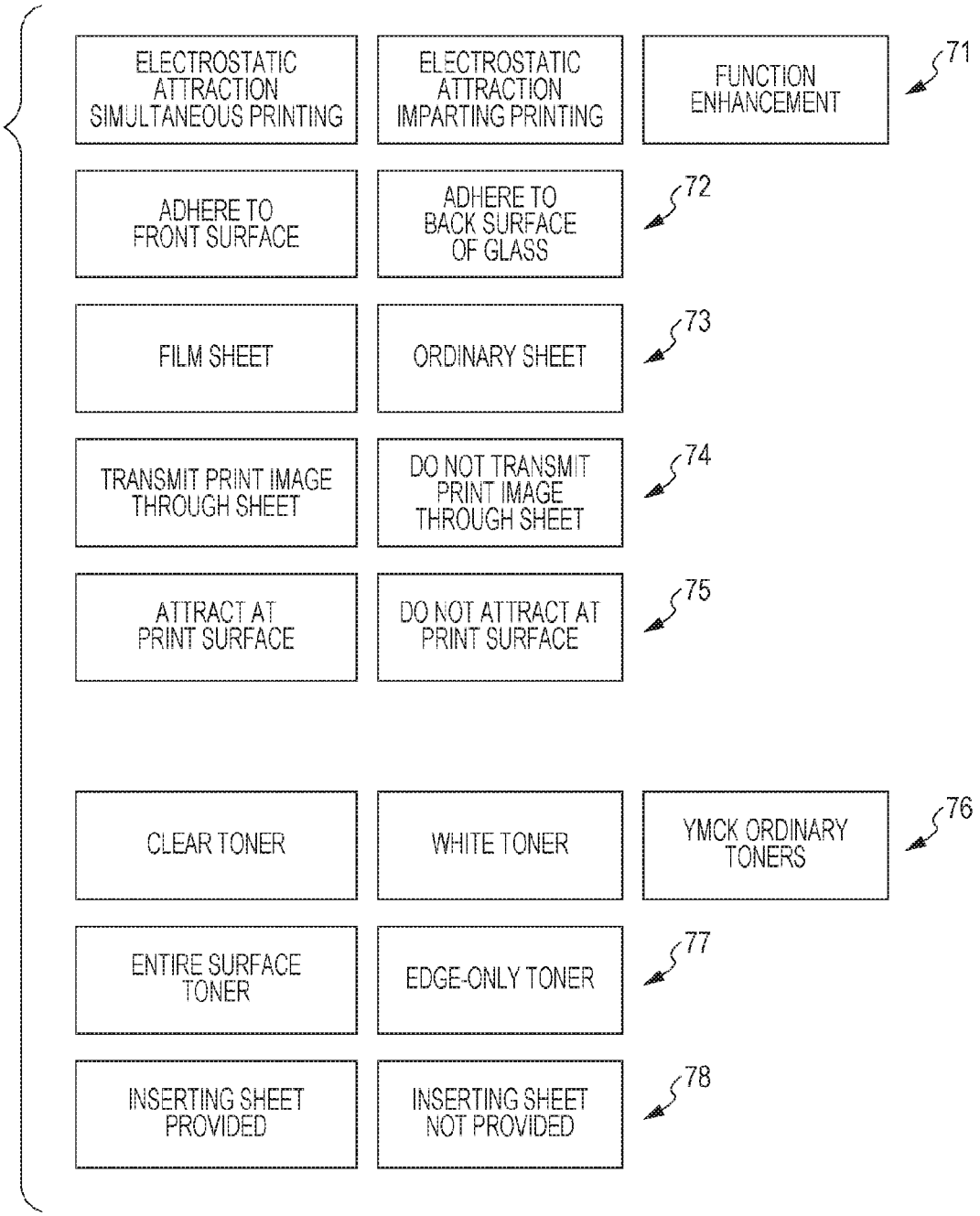
FIG. 3 illustrates an example of a display on a user interface (UI) screen that is related to formation of an electrostatic attraction sheet.

FIG. 3 illustrates an example of a display on a user interface (UI) screen, which is related to formation of an electrostatic attraction sheet, of the control panel 70. In FIG. 3, a driver UI screen display is provided on a display of the control panel 70. As attraction mode items to be selected, mode selection 71, adhering surface selection 72, sheet selection 73, sheet transmission/non-transmission selection 74, print surface attraction selection 75, toner type selection 76, attraction region selection 77, and inserting sheet selection 78 are displayed on the driver UI screen. As a result of selecting any of these items, items that no longer need to be selected and items that contradict the selection are grayed out, and are excluded from operations to be performed by a user. The items shown in FIG. 3 may be displayed in any way. In addition to all of the items being selectable on one screen at the same time, for example, when one item has been selected, items may be successively displayed or multiple items may be sequentially displayed at a time.

The mode selection 71 includes an electrostatic attraction simultaneous printing mode and an electrostatic attraction imparting printing mode. The mode selection 71 also includes a function enhancement mode for enhancing the electrostatic attraction function of a sheet on which an electrostatic attraction toner image has been already formed by charging the electrostatic attraction toner image. Any of these modes is selected.

In the electrostatic attraction simultaneous printing mode, at the same time that an ordinary print image is formed on a sheet on the basis of acquired rendering information by using Y toner, M toner, C toner, and K toner, that is, in the flow of print operations for outputting the ordinary print image, the sheet having an electrostatic attraction function of causing the sheet to be attracted to an adhesion surface by static electricity is output. For example, after the ordinary print image has been formed on a first surface (front surface) of the sheet by using Y toner, M toner, C toner, and K toner, the sheet is reversed to form an electrostatic attraction toner image on a second surface (back surface) of the sheet.

In the electrostatic attraction imparting printing mode, an electrostatic attraction function is thereafter imparted to an existing print image that has been output once. An electrostatic attraction function may be imparted to other sheets that have been printed by another printer.

When the electrostatic attraction simultaneous printing mode is selected, for example, an unprinted film sheet is placed on the manual feeding tray 31, and an instruction is issued to a user to cause the user to carry out print instructions. When the electrostatic attraction imparting printing mode is selected, the film sheet that has already been printed is placed on the manual feeding tray 31 with a surface thereof not provided with an electrostatic attraction function faced downward, and an instruction is issued to the user to carry out print instructions. When the function enhancement mode is selected, for example, the sheet is placed on the manual feeding tray 31 with a surface on which electrostatic attraction toner is provided faced downward to recharge the surface on which the electrostatic attraction toner is provided; and an instruction is issued to a user to carry out print instructions.

When a side that is viewed by a human being is defined as a front surface, the adhering surface selection 72 includes an "adhere to front surface" item and an "adhere to back surface of glass" item. In the "adhere to front surface" item, a sheet is adhered to a front surface of an adhesion surface of, for example, glass or a metal locker. In the "adhere to back surface of glass" item, for example, a sheet is adhered to a back surface of, for example, glass, so that an ordinary image is transmitted through the glass and is seen from the side of the front surface.

The sheet selection 73 includes a "film sheet" item and an "ordinary sheet" item. In the "film sheet" item, for example, a transparent film made of a material having high insulation property, such as a PET film, is selected. In the "ordinary sheet" item, commercially available (general) sheets, such as a P sheet having a basis weight of 64 g/m$^2$ and a thickness of 88 μm and an SP sheet having a basis weight of 60 g/m$^2$ and a thickness of 81 μm, are selected.

When a side that is viewed by a human being is defined as a front surface, the sheet transmission/non-transmission selection 74 includes a "transmit print image through sheet" item, in which a print image using Y toner, M toner, C toner, and K toner is formed on a back surface of a sheet and transmitted through the sheet, and is shown to a person, and a "do not transmit print image through sheet" item, in which a print image is not transmitted through a sheet and the print image is formed on a front surface of the sheet.

The print surface attraction selection 75 includes an "attract at print surface" item in which an electrostatic attraction toner image is formed with respect to a surface of a print image using Y toner, M toner, C toner, and K toner (YMCK print surface), such as on the print image or in addition to the print image; and in which the sheet is, at the print surface, attracted to an adhesion surface. The print surface attraction selection 75 also includes a "do not attract at print surface" item in which, when a print image using Y toner, M toner, C toner, and K toner has been formed on a front surface of a sheet, an electrostatic attraction toner image is formed on a back surface of the sheet without attracting the sheet at the print surface to the adhesion surface. In this way, the attraction mode is such that which surface is to be subjected to adhesion is selectable, and the controller changes the control based on which surface is to be subjected to the adhesion.

In the toner type selection 76, as toner used to form the electrostatic attraction toner image, "clear toner", "white toner", or "YMCK ordinary toners" may be selected. In the exemplary embodiment, clear toner and white toner are provided as toner used exclusively for attraction. When "YMCK ordinary toners" is selected, only the YMCK ordinary toners are used for a print image, that is, attraction is performed without using toner used exclusively for attraction. When "YMCK ordinary toners" is selected, for example, any color may be selected through, for example, a color selection dialog box. It is possible to impart an electrostatic attraction function by, for example, thickening a toner layer as a result of applying toner of the same color to a YMCK print surface on which an image is formed on the basis of acquired rendering information.

The "attraction region selection 77" includes an "entire surface toner" item and a "edge-only toner" item. In the "entire surface toner" item, electrostatic attraction toner is provided on the entire attraction surface. In the "edge-only toner" item, partial toner, that is, electrostatic attraction toner is provided only on the four edges of the attraction surface.

In the inserting sheet selection 78, "inserting sheet provided" or "inserting sheet not provided" may be selected. When "inserting sheet provided" is selected, the control panel 70 urges a user to set a sheet that is used as an inserting sheet on the inserting sheet tray 32, and waits for an operation that is performed by the user. A timing in which the inserting sheet is transported depends upon whether an adhering surface of an electrostatic attraction sheet for the inserting sheet is the front surface or the back surface of the sheet.

Description of Electrostatic Attraction Sheet

Next, an electrostatic attraction sheet, which is a print sheet, to which the exemplary embodiment is applied is described.

FIGS. 4A to 4D illustrate an example of a pattern of the electrostatic attraction sheet to which the exemplary embodiment is applied.

Figure 4A:
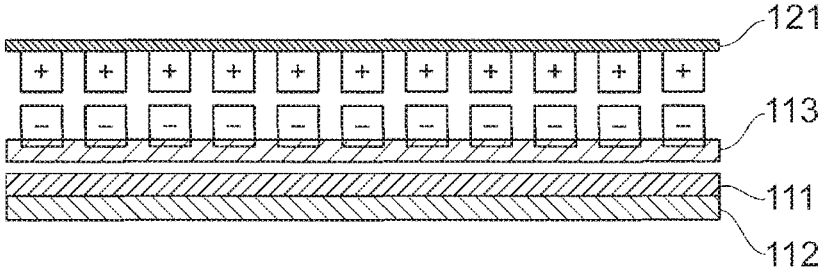
FIGS. 4A to 4D each illustrate an example of a pattern of the electrostatic attraction sheet to which the exemplary embodiment is applied.

FIG. 4A illustrates a YMCK print surface 112 that is formed on a first surface (front surface) of a sheet material 111 (which is a sheet body) and that corresponds to an image formed by the first image forming unit on the basis of acquired rendering information including one or both of a text and an illustration. An attraction toner layer 113, which is formed of electrostatic attraction toner and which corresponds to an image formed by the second image forming unit, is formed on a second surface (back surface) of the sheet material 111. With static electricity of the attraction toner layer 113 being maintained, the attraction toner layer 113 is adhered to a front surface of an adhesion surface 121 of, for example, glass or a metal locker.

Figure 4B:
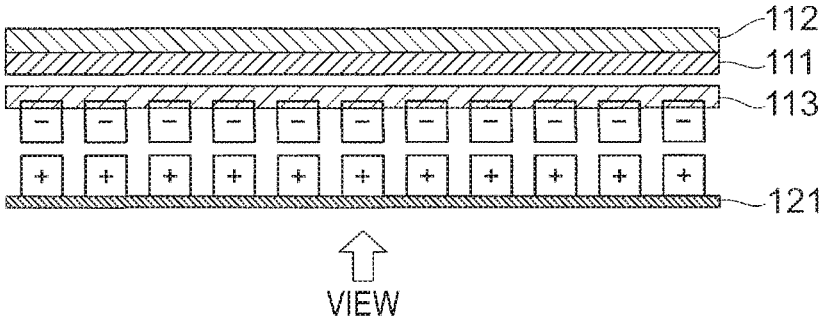

FIG. 4B illustrates a pattern that differs from that shown in FIG. 4A in that the YMCK print surface 112 is seen through the adhesion surface 121. As in FIG. 4A, the YMCK print surface 112 is formed on the first surface (front surface) of the sheet material 111, and the attraction toner layer 113 is formed on the second surface (back surface). In FIG. 4B, the sheet is viewed from a lower side of the figure by a person. In the example in FIG. 4B, the attraction toner layer 113 needs to be formed of clear toner. In addition, the sheet material 111 is a film sheet that transmits an image therethrough. In the example in FIG. 4B, for example, an electrostatic attraction sheet is adhered from an inner side of a glass showcase of a tenant facing a road, and the sheet is used so as to allow a person to view the electrostatic attraction sheet from an outer side of the glass showcase. Therefore, transparent glass is used for the adhesion surface 121. The YMCK print surface needs to be an image that is capable of being seen from the back side of the sheet material 111. This image is an inverted image with its left and right sides reversed.

Figure 4C:
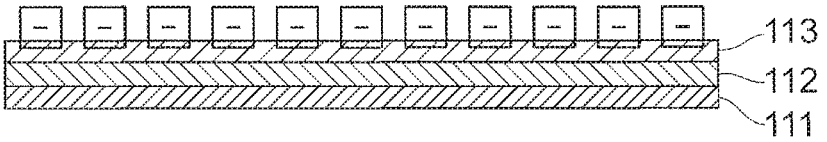

In FIG. 4C, the YMCK print surface 112 is formed on the sheet material 111, and the attraction toner layer 113 is formed in the same plane as the YMCK print surface 112, such as on the YMCK print surface 112.

Figure 4D:
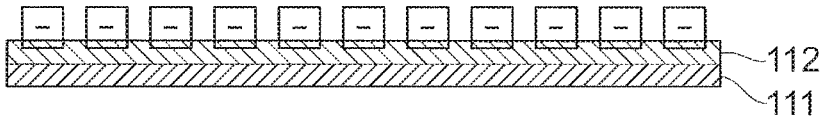

In FIG. 4D, the YMCK print surface 112 is formed on the sheet material 111 on the basis of acquired rendering information, and an electrostatic attraction function is imparted to the YMCK print surface 112 by, for example, further applying toner to the YMCK print surface 112 on the basis of the same rendering information. The YMCK print surface 112 is electrostatically adhered to the adhesion surface 121.

Method of Producing Sheet Having Electrostatic Attraction Function

Next, methods of producing the sheets in FIGS. 4A to 4D having an electrostatic attraction function are described.

(1) Method of Producing Print Sheet in FIG. 4A

First, the case in which the print sheet in FIG. 4A is formed by simultaneous printing is described.

On the driver UI screen in FIG. 3, first, in the mode selection 71, the electrostatic attraction simultaneous printing mode is selected; and, in the adhering surface selection 72, the "adhere to front surface" item is selected. In the sheet selection 73, either one of the items thereof may be selected. In the sheet transmission/non-transmission selection 74, the "do not transmit print image through sheet" item is selected; and, in the print surface attraction selection 75, the "not attract at print surface" item is selected. In the toner type selection 76, any one of the items may be selected; and in the attraction region selection 77 and inserting sheet selection 78, either one of the items thereof may be selected.

The image processing device 50, which is a controller, of the image forming apparatus 1 controls the image forming apparatus 1 as follows on the basis of the aforementioned specification from the driver UI screen in FIG. 3. First, if the sheet material 111 is an ordinary sheet, the sheet material 111 is supplied from the sheet feeding tray 21; and, if the sheet material 111 is a film sheet, such as an OHP sheet, the sheet material 111 is supplied from the manual feeding tray 31. Then, the YMCK print surface 112 is formed on the first surface (front surface) of the sheet material 111 by the image forming device 10, after which the sheet that has passed through the fixing unit 16 is reversed through the reverse path 27. Thereafter, the attraction toner layer 113, which is formed from an electrostatic attraction toner image, is formed on the second surface (back surface) of the sheet material 111, and the sheet material 111 is discharged onto the paper exit tray 25. When "inserting sheet provided" is selected, a sheet is transported from the inserting sheet tray 32 at a timing so as to be in accordance with the position of the second surface (back surface) of the sheet material 111; or a sheet is supplied so as to be placed on the sheet discharged on the paper exit tray 25.

When the print sheet in FIG. 4A is to be formed by electrostatic attraction imparting printing, the electrostatic attraction imparting printing mode in the mode selection 71 is selected. Then, a sheet on which the YMCK print surface 112 has been formed on the first surface (front surface) is placed on, for example, the manual feeding tray 31 so that the attraction toner layer 113 is formed on the second surface (back surface) of the sheet material 111. In the example in FIG. 1, the sheet is placed on the manual feeding tray 31 with the second surface (back surface) faced downward. Thereafter, for example, a start button (not shown) is pressed to form the attraction toner layer 113 on the second surface (back surface).

(2) Method of Producing Print Sheet in FIG. 4B

Next, the case in which the print sheet in FIG. 4B is formed by simultaneous printing is described. In FIG. 4B, in the mode selection 71, the electrostatic attraction simultaneous printing mode is selected; in the adhering surface selection 72, the "adhere to back surface of glass" item is selected; in the sheet selection 73, the "film sheet" item is selected; and in the sheet transmission/non-transmission selection 74, the "transmit print image through sheet" item is selected. In the print surface attraction selection 75, the "not attract at print surface" item is selected; and, in the toner type selection 76, the "clear toner" item is selected. In the attraction region selection 77 and in the inserting sheet selection 78, either one of the items thereof is selected. However, when the "edge-only toner" item in the attraction region selection 77 is selected, if the attraction toner layer is shifted from a rendering region, "clear toner" need not be used.

When the YMCK print surface 112 is to be formed, the image processing device 50, which is a controller, of the image forming apparatus 1, for example, inverts the rendering information that has been output from the client PC 2, and outputs the inverted information to the image forming device 10. The other image forming operations are the same as those in (1) above.

The movements when the electrostatic attraction imparting printing mode in the mode selection 71 is selected are the same as those in (1) above.

(3) Method of Producing Print Sheet in FIG. 4C

The case in which the print sheet in FIG. 4C is formed by simultaneous printing is described.

On the driver UI screen in FIG. 3, first, the electrostatic attraction simultaneous printing mode in the mode selection 71 is selected. Then, when the "attract at print surface" item in the print surface attraction selection 75 is selected, the selection of the other items is restricted. For example, when the "adhere to front surface" item in the adhering surface selection 72 is selected, the print surface is viewed from a lower side in FIG. 4C. The sheet selection 73 for selecting the type of sheet material 111 is such that only a film sheet is used, so that the items of the sheet selection 73 are grayed out so as not to allow the user to select the items. Similarly, since the print image is transmitted through the sheet material 111, the items of the sheet transmission/non-transmission selection 74 are also grayed out. In the toner type selection 76, any of the items thereof is selected; and in the attraction region selection 77 and the inserting sheet selection 78, either one of the items thereof is selected.

When the "attract at print surface" item in the print surface attraction selection 75 is selected, and the "adhere to back surface of glass" item in the adhering surface selection 72 is selected, the print sheet is viewed from an upper side in FIG. 4C; only clear toner is used; and the items of the toner type selection 76 are grayed out to prevent selection of the items. Since a print image is not transmitted through the sheet material in the first place, the items of the sheet transmission/non-transmission selection 74 are also grayed out. In the sheet selection 73, the attraction region selection 77, and the inserting sheet selection 78, either of the items thereof may be selected. However, when the "edge-only toner" item in the "attraction region selection 77" is selected, if the attraction toner layer is shifted from a rendering region, clear toner need not be used.

The image processing device 50, which is a controller, of the image forming apparatus 1 controls the image forming apparatus 1 as follows on the basis of the aforementioned specification from the driver UI screen in FIG. 3. First, if the sheet material 111 is an ordinary sheet, the sheet material 111 is supplied from the sheet feeding tray 21; and, if the sheet material 111 is a film sheet, such as an OHP sheet, the sheet material 111 is supplied from the manual feeding tray 31. Then, the YMCK print surface 112 is formed on the first surface (front surface) of the sheet material 111 by the image forming device 10, after which the sheet that has passed through the fixing unit 16 is retransported towards the image forming device 10 through the circulation path 28. Thereafter, the attraction toner layer 113 is capable of being formed in the same plane as the YMCK print surface 112.

When the "adhere to front surface" item in the adhering surface selection 72 is selected, and the print surface is viewed from a lower side in FIG. 4C, it is necessary to transmit an image through the sheet material 111 and show the image. When forming the YMCK print surface 112, an inverted image based on rendering information that has been inverted is output to the image forming device 10.

When the electrostatic attraction imparting printing mode in the mode selection 71 is selected, the user is guided to cause the first surface (front surface) of the sheet material 111 on which the YMCK print surface 112 has been formed to be re-transported to the image forming device 10. For example, through the driver UI screen of the control panel 70, the user is instructed to place the sheet already having the YMCK print surface 112 formed at the first surface (front surface) onto the manual feeding tray 31. Thereafter, the sheet is transported to impart an electrostatic attraction function to the sheet.

(4) Method of Producing Print Sheet in FIG. 4D

The case in which the print sheet in FIG. 4D is formed by simultaneous printing is described.

On the driver UI screen in FIG. 3, first, the electrostatic attraction simultaneous printing mode in the mode selection 71 is selected. Then, when the "attract at print surface" item in the print surface attraction selection 75 is selected and the "YMCK ordinary toners" item in the toner type selection 76 is selected, the print sheet pattern in FIG. 4D is formed.

Since, in general, it is difficult to print by placing the same images upon each other, in the print sheet pattern in FIG. 4D, electrostatic attraction imparting printing is not performed.

When the "adhere to front surface" item in the adhering surface selection 72 is selected and the print sheet is viewed from a lower side in FIG. 4D, since the sheet selection 73 for selecting the type of sheet material 111 is such that only a film sheet is used, the items in the sheet selection 73 are grayed out so as not to allow the user to select the items. Similarly, since a print image is transmitted through the sheet material 111, the items in the sheet transmission/non-transmission selection 74 are also grayed out. In the attraction region selection 77 and inserting sheet selection 78, either of the items thereof may be selected. However, since as regards the "edge-only toner" item, the toner amount is generally small, in order to ensure the toner amount for forming an electrostatic attraction toner image, it is generally not desirable to select the "edge-only toner".

When the "adhere to back surface of glass" item in the adhering surface selection 72 is selected, and the print surface is viewed from an upper side in FIG. 4D, an image is not transmitted through the sheet, so that the items in the sheet transmission/non-transmission selection 74 are grayed out. In the sheet selection 73, the attraction region selection 77, and the inserting sheet selection 78, either of the items thereof is selected.

The image processing device 50, which is a controller, of the image forming apparatus 1 controls the image forming apparatus 1 as follows on the basis of the aforementioned specification from the driver UI screen in FIG. 3. First, if the sheet material 111 is an ordinary sheet, the sheet material 111 is supplied from the sheet feeding tray 21; and, if the sheet material 111 is a film sheet, such as an OHP sheet, the sheet material 111 is supplied from the manual feeding tray 31. Then, the YMCK print surface 112 is formed on the first surface (front surface) of the sheet material 111 by the image forming device 10, after which the sheet that has passed through the fixing unit 16 is re-transported to the image forming device 10 via the circulation path 28. Then, on the basis of acquired rendering data, a second printing operation using Y toner, M toner, C toner, and K toner is performed to increase the electrostatic attraction function, and the sheet is output.

When the function enhancement mode in the mode selection 71 on the driver UI screen in FIG. 3 is selected, the image forming apparatus 1 functions as an enhancing unit that enhances the electrostatic attraction function by charging the electrostatic attraction toner image on the sheet material 111. After placing the sheet on the manual feeding tray 31, when the user presses a start button (not shown), electric charge is applied to the sheet at the transferring unit 15 of the image forming device 10 to restore and enhance the electrostatic attraction function.

Description of Electrostatic Attraction Characteristics

Next, the structure for providing electrostatic attraction characteristics according to the exemplary embodiment is described.

FIGS. 5A to 5D illustrate a state of charge and a state of adhesion of a print sheet having electrostatic attraction characteristics according to the exemplary embodiment.

Figure 5A:
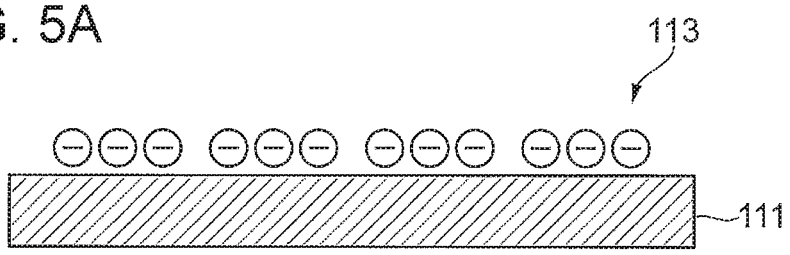
FIGS. 5A to 5D illustrate a state of charge and a state of adhesion of a print sheet having electrostatic attraction characteristics according to an exemplary embodiment.

FIG. 5A illustrates a state at the time of print out in which the attraction toner layer 113 formed from an electrostatic attraction toner image is formed on the sheet material 111. In the example in FIG. 5A, the attraction toner image 113 has a minus (−) electric charge. The attraction toner layer 113 is in a charged state at the time of print out due to the following reasons. The first reason is that the toner layer 113 is a charged state due to contact and friction when a sheet is being transported or when the toner layer 113 is press-contacted by the rollers of the transporting device 20. The second reason is that, in particular, since the interior of the image forming apparatus 1 is hot and dry, static electricity tends to be generated. The third reason is that the attraction toner layer 113 is in a state in which semi-molten toner that is kept charged remains. The fourth reason is that, if there are holes in the front surface of the attraction toner layer 113, a larger amount of electric charge is accumulated, so that the electric charge does not easily escape. Other reasons are that, for example, the attraction toner layer 113 tends to be polarized due to a charging additive material in the toner in the first place, and the attraction toner layer 113 is formed of an insulating material (resin), so that electric charge does not easily escape.

Figure 5B:
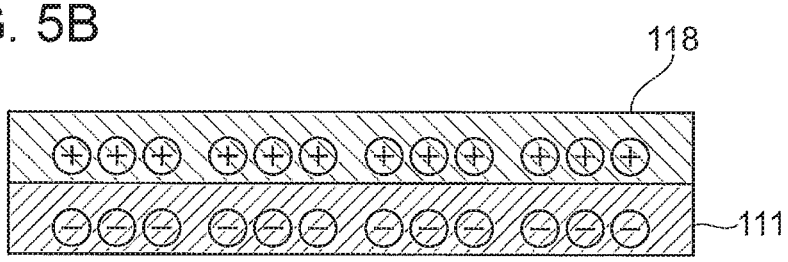

FIG. 5B illustrates a state in which an inserting sheet 118 is placed on a surface of the sheet material 111 on which the attraction toner layer 113 is formed. As the inserting sheet 118, an unprinted ordinary sheet is used. In a state in which the inserting sheet 118 is placed on the attraction toner layer 113 on the sheet material 111, the minus (−) electric charge of the attraction toner layer 113 is neutralized by a plus (+) electric charge of the inserting sheet 118. That is, the plus (+) electric charge of the inserting sheet 118 is attracted with the same strength as that of the charged sheet material 111, so that an electrically stabilized state is about to be realized.

Figure 5C:
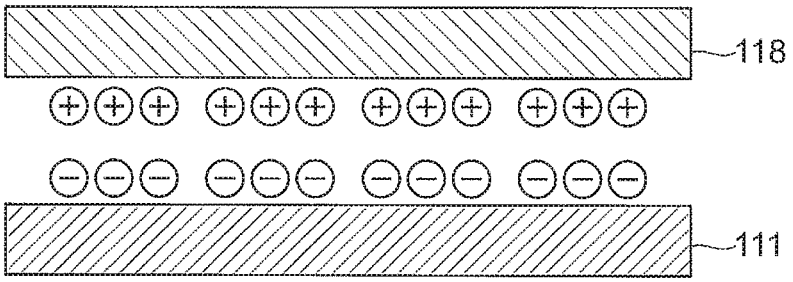

FIG. 5C illustrates a state in which the inserting sheet 118 has separated from the sheet material 111 from a state in FIG. 5B in which the inserting sheet 118 is adhered to the charged sheet material 111. FIG. 5B illustrates a neutralized state. However, when the inserting sheet 118 and the sheet material 111 are separated from each other again from the neutralized state, the inserting sheet 118 and the sheet material 111 are restored to their originally charged states and polarized states, and the charged state of the sheet material 111 is restored.

Figure 5D:
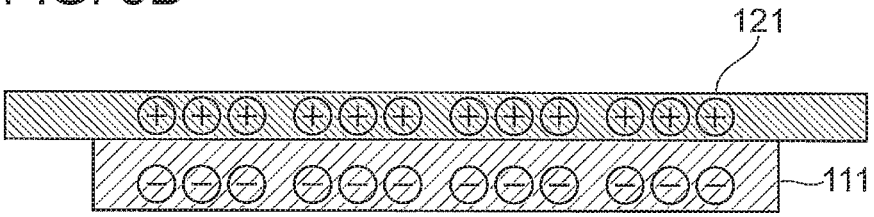

Then, as illustrated in FIG. 5D, when the sheet material 111 is brought closer to the adhesion surface 121 of glass or a metal, the electrostatic attraction function of the charged sheet material 111 allows the sheet material 111 to adhere to the adhesion surface 121.

Evaluation of Electrostatic Attraction Function

FIG. 6 shows experiment results in which the electrostatic attraction function is evaluated. Here, experiment result Nos. 1 to 7 are shown. In all of the present experiments, an OHP sheet, which is a transparent film, is used as a sheet (sheet material 111); and a J sheet (having a basis weight of 82 g/m$^2$), which is a printer sheet (produced by Fuji Xerox Co., Ltd.), is used as an inserting sheet. The toner used is white toner, and the coverage is selected from a range of 0 to 100%. Here, the term "coverage" refers to a dot area ratio of a development toner image. For example, when the entire sheet is blackened with a solid image, the coverage of the toner is 100%. Evaluation items include charging voltage immediately after printing, and adhesion to an object (adhesion surface 121) two days later. The object used here is a metal locker. As a result of the examination, it is clear that, if the object is a metal locker and the voltage is approximately −140 V, the sheet is barely attracted to the metal locker, whereas if the object is a metal locker and the voltage is less than or equal to −140 V, the sheet is not attracted to the metal locker. The experiment results are those obtained when an antistatic brush is removed from the image forming apparatus 1. However, the presence and absence of the antistatic brush do not largely affect the experiment results.

First, in the experiment result No. 1, an electrostatic attraction toner image is not formed, and the coverage is 0. The charging voltage immediately after printing at this time is −814 V, and, two days later, the sheet does not adhere to the object. Therefore, the evaluation result is "poor".

In the experiment result No. 2, the coverage is 95% and white toner is used to form an electrostatic attraction toner image. The coverage of 95% refers to a coverage of approximately 95% when the edges of the sheet are not printed, that is, when the coverage when the edges are also printed is 100% in the image forming apparatus 1. Since the charging voltage after printing is −841 V and the sheet adheres to the object even two days later, the evaluation result is "good".

In each of the experiment results No. 3 to No. 5, a different coverage is used. White toner is used to form an electrostatic attraction toner image. In the experiment result No. 3, a 1-on-2-off pattern vertical image in which one line is on and two lines are off in a vertical direction (subscanning direction) is used, and the coverage is 33%. In the experiment result No. 4, a 1-on-2-off pattern horizontal image in which one line is on and two lines are off in a horizontal direction (main scanning direction) is used, and the coverage is 33%. In the experiment result Nos. 3 and 4, the charging voltages immediately after printing are −699V and −667V, respectively; and in the experiments of adhering the sheet to the object two days later, the sheet is not capable of being attracted to the object. Therefore, the evaluation result is "poor".

In the experiment result No. 5, an image whose coverage is 50% is used and white toner is used to form an electrostatic attraction toner image. The charging voltage immediately after printing is −665 V, and the adhesion time is not long two days later. However, the sheet is briefly adhered to the object, that is, even though the adhesion time is not as long as in the examples whose evaluation results is good, the sheet is attracted to the object. Therefore, the evaluation result is OK.

In the experiment result No. 6, an electrostatic attraction toner image made of white toner and being a 1-on-2-off pattern vertical image in which one line is on and two lines are off in a vertical direction (subscanning direction) is superimposed on an image having a coverage of 95%, to form an image. The charging voltage immediately after printing is −660 V, and the sheet properly adheres to the object even two days later. Therefore, the evaluation result is "good".

In the experiment result No. 7, an electrostatic attraction toner image having a coverage of 100% is formed by using white toner and by printing up to the edges of paper, that is, by edge-less printing by the image forming apparatus 1. In the experiment result, the charging voltage immediately after printing is −646 V, and the sheet properly adheres to the object even two days later. Therefore, the evaluation result is "good".

Accordingly, the results two days later show that unless the electrostatic attraction toner image does not exist, the charging voltage that is generated is not capable of being maintained. In addition, the experiment results show that if the amount of toner that forms the electrostatic attraction toner image is large, it is capable of being maintained even two days later; whereas if the amount of toner that forms the electrostatic attraction toner image is small, an electric charge retaining amount is also small. In these experiments, it is desirable that the coverage, which serves as the amount of toner that forms the electrostatic attraction toner image, be 50% or greater.

In these experiments, a J sheet is used as the inserting sheet 118. In preliminary experiments, an OHP sheet is used as the inserting sheet 118. The retaining performance by the inserting sheet 118 is better than that by the J sheet. This is thought to be because many holes in the sheet contribute to retaining electric charge.

The charge of sheets whose charging potential has dropped is restored by friction. The experiments show that that, when the sheets are recharged through the imaging forming apparatus 1, the electrostatic attraction function may be enhanced and the charge may be restored.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an acquiring unit configured to acquire rendering information including one or both of a text and an illustration;

a first image forming unit configured to form an image on a sheet material based on the rendering information that has been acquired; and a second image forming unit configured to form an electrostatic attraction toner image on the sheet material, the electrostatic attraction toner image being for imparting an electrostatic attraction function to the sheet material, the electrostatic attraction function allowing the sheet material to be attracted to an object surface by using static electricity.

2. The image forming apparatus according to claim 1, wherein the second image forming unit is configured to form the electrostatic attraction toner image on a back surface of the sheet material on which the image is formed by the first image forming unit, the back surface being opposite to a surface of the sheet material on which the image is formed by the first image forming unit.

3. The image forming apparatus according to claim 1, further comprising an enhancing unit configured to enhance the electrostatic attraction function by charging the electrostatic attraction toner image on the sheet material.

4. An image forming apparatus comprising:

an image forming device configured to form a toner image on a sheet material;

a user interface configured to allow a user to specify an attraction mode in which an electrostatic attraction function is imparted to the sheet material, the electrostatic attraction function allowing the sheet material to be attracted to an object surface by using static electricity; and a controller configured to receive a specification of the attraction mode from the user through the user interface, and to perform control so as to form an electrostatic attraction toner image on the sheet material by using the image forming device.

5. The image forming apparatus according to claim 4, wherein the attraction mode includes one or both of an electrostatic attraction simultaneous printing mode, in which the electrostatic attraction toner image is formed at the same time that an image including one or both of a text and an illustration is formed, and an electrostatic attraction imparting printing mode, in which formation of the electrostatic attraction toner image and formation of the image including one or both of the text and the illustration are performed separately.

6. The image forming apparatus according to claim 4, wherein the attraction mode is such that which surface is to be subjected to adhesion is selectable, and wherein the controller is configured to change the control based on which surface is to be subjected to the adhesion.

7. A print sheet comprising:

a sheet body on which information is provided; and an electrostatic attraction toner image that is formed on a surface of the sheet body to be adhered to an object, wherein the electrostatic attraction toner image is configured to cause the sheet body to be attracted to the object by using static electricity.

8. The print sheet according to claim 7, wherein the information on the sheet body includes a toner image that is formed on a surface of the sheet body, the toner image including one or both of a text and an illustration, and wherein the surface on which the electrostatic attraction toner image is formed, and to be adhered to the object is a back surface of the sheet body.

9. The print sheet according to claim 7, wherein an electrostatic attraction function is enhanced by recharging the electrostatic attraction toner image when the electrostatic attraction function has been reduced.

10. The print sheet according to claim 7, wherein the information on the sheet body includes a toner image.

* * * * *